United States Patent [19]

Allen et al.

[11] Patent Number: 4,852,734

[45] Date of Patent: Aug. 1, 1989

[54] CIGARETTE PACKAGE

[75] Inventors: John S. Allen; John P. Butler; Floyd L. Phillips, Jr., all of Winston-Salem, N.C.

[73] Assignee: R. J. Reynolds Tobacco Company, Winston-Salem, N.C.

[21] Appl. No.: 247,221

[22] Filed: Sep. 21, 1988

[51] Int. Cl.[4] ..... B65D 85/10

[52] U.S. Cl. ..... 206/273; 229/160.1; 229/16 A

[58] Field of Search ..... 206/271, 273; 229/160.1, 16 A

[56] References Cited

U.S. PATENT DOCUMENTS

| | | | |
|---|---|---|---|
| 3,858,788 | 1/1975 | Phillips, Jr. | 229/44 CB |
| 3,944,066 | 3/1976 | Niepmann | 206/268 |
| 4,114,777 | 9/1978 | Fröhling et al. | 229/44 CB |

FOREIGN PATENT DOCUMENTS 2059387 4/1981 United Kingdom .

*Primary Examiner*—Carroll B. Dority, Jr.

[57] ABSTRACT

An assembled hinged lid cigarette package has the lid reinforcing panel held in place against the front wall of the lid portion. Tabs extend from the sides of the lid reinforcing panel and are folded either (i) to fit between the inner and outer side walls of the lid portion, or (ii) within notches cut in each of the inner side walls of the lid portion.

10 Claims, 4 Drawing Sheets

CIGARETTE PACKAGE

BACKGROUND OF THE INVENTION

The present invention relates to a package for smoking articles such as cigarettes, and in particular to a cigarette package of the hinged lid type.

Popular smoking articles such as cigarettes conventionally have been sold in packages. Typically, each package contains about 20 cigarettes. One type of popular cigarette package is the so-called "hard pack," "crush proof box" or "hinged lid package." Such a package has a generally cuboid-type shape, is manufactured from resilient paperboard and includes an outer wrap of transparent polypropylene film.

Hinged lid cigarette packages conventionally are made from two paperboard blanks. One blank forms the body and lid of the package. The second blank forms an insert or inner frame which is assembled to the inside of the front and side walls of the package. The inner frame projects above the front and side walls of the package body, and provides a seal between the lid and body when the package is closed. Other types of designs of blanks for hinged lid cigarette packages can be of the type described in U.S. Pat. Nos. 3,874,581 to Fox et al and 3,944,066 to Niepmann.

One of the features common to hinged lid cigarette packages is the so-called "lid reinforcing panel" or "lid stabilizer flap." Such a feature provides rigidity as well as an aesthetic appearance to the front of the lid portion of the package, when the package is closed as well as when the package is opened. It is common practice to apply adhesive to the inner surface of the lid reinforcing panel in order to adhere that panel to the inner front package. Unfortunately, the lid reinforcing panel is not always held in place by the adhesive due to the short adhesive setting time which is experienced during cigarette packaging operations. As a result, the cigarette manufacturer using automated high speed equipment may experience problems with the quality control of its cigarette packages. In particular, the lid reinforcing panel may tend to separate from its intended position against the inner face of the front lid portion, especially after the package is opened.

It would be highly desirable to provide a hinged lid type cigarette package wherein the lid reinforcing panel is maintained in its desired position during the useful lifetime of the package.

SUMMARY OF THE INVENTION

The present invention relates to a hinged lid package for smoking articles such as cigarettes. The package includes a body portion and a lid portion which is integrally hinged to the body portion. The body portion includes a front wall, a bottom wall, a rear wall, inner side walls and outer side walls. The lid portion includes a front wall, a top wall, a rear wall integrally hinged to the rear wall of the body portion, inner side walls and outer side walls. The lid portion further includes a lid reinforcing panel integrally connected to the front wall of the lid portion.

In one aspect, tabs integrally connected to each side of the lid reinforcing panel are folded so as to be positioned in a region between the inner and outer lid side walls of an assembled package. As such, the lid reinforcing panel is effectively and efficiently held in place against the inner face of the front wall of the lid portion.

In another aspect, tabs integrally connected to each side of the lid reinforcing panel are folded so as to be positioned in a region defined as a notch in the front side edge of the inner side walls of the lid portion of an assembled package. As such, the lid reinforcing panel is effectively and efficiently held in place against the inner face of the front wall of the lid portion. In particular, each tab and corresponding notch are of a shape such that the tab fits snuggly within the notch when the package is assembled.

The packages of the present invention are manufactured from suitable blanks in much the same manner as are conventional hinged lid cigarette packages. The blanks so employed allow the cigarette manufacturer to produce assembled packages of consistently high quality.

DETAILED DESCRIPTION OF THE PREFERRED EMBODIMENTS

Figure 1:
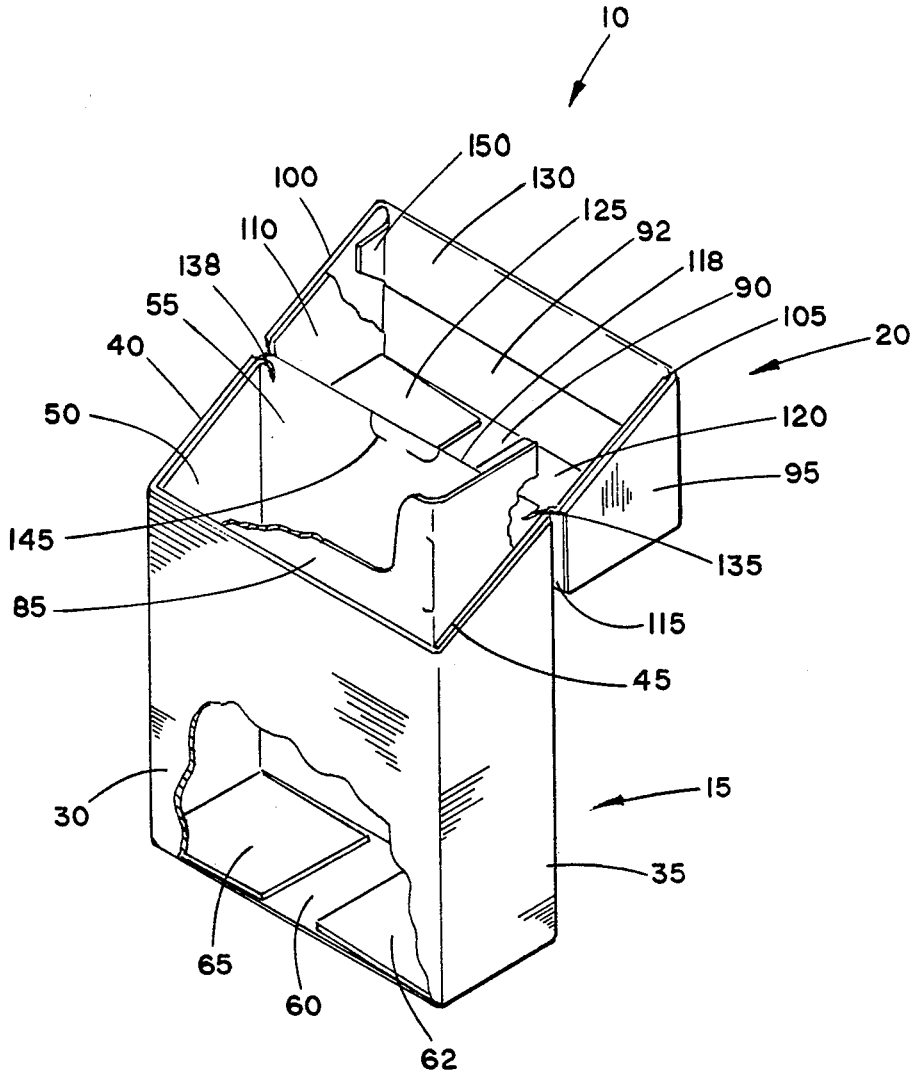
FIGS. 1 and 2 are perspectives of representative assembled hinged lid packages of the invention in the open position.

Referring to FIG. 1, hinged lid package or cigarette box 10 includes a body portion 15 and a lid portion 20.

The body portion includes a front wall 30 (shown as partially cut away), outer side walls 35 and 40, inner side walls 45 and 50, rear wall 55, bottom wall 60, and bottom flaps 62 and 65. The upper edges of the inner and outer side walls of the body of the package can extend from the front of the package to the back thereof at an upward incline of about 30°, or any other desired angle. Generally, the inner and outer side walls of each side of the body are of similar shape and dimension. An inner liner or collar 85 (shown as partially cut away) is glued or otherwise secured to the inner surface of a portion of the front wall 30 and the inner side wall 45 and 50. It is understood that packages having integral inner liners can be employed, if desired.

The lid portion 20 includes a top wall 90, front wall 92, outer side walls 95 and 100, inner side wall 105 and inner side wall 110 (shown as partially cut away), and rear wall 115 which is integrally hinged to rear wall 55 of the body 15. The lower edges of the inner and outer side walls of the lid of the package can extend from the front of the package to the back thereof at an upward incline of about 30°, or any other desired angle. Generally, the inner and outer side walls of each side of the lid are of similar shape and dimension.

Hinge 118 has the form of a crease, fold or score line across the rear wall of the box. The lid portion also includes top flaps 120 and 125, and reinforcing panel 130. The box 10 also can include tear minimizers 135 and 138, and stress reliever 145 in the region of hinge 118; as is common in conventional hinge lid package manufacture.

Tab 150 is integrally connected to one side of the lid reinforcing panel 130, and extends between lid outer side wall 100 and lid inner side wall 110 (shown as cut away). In particular, a fold between the reinforcing panel and the tab 150 allows the tab to fit between the two side wall portions. A similar tab (not shown) is connected to the opposite side of the lid reinforcing panel, and is fit between lid outer side wall 95 and lid inner side wall 105.

Figure 2:
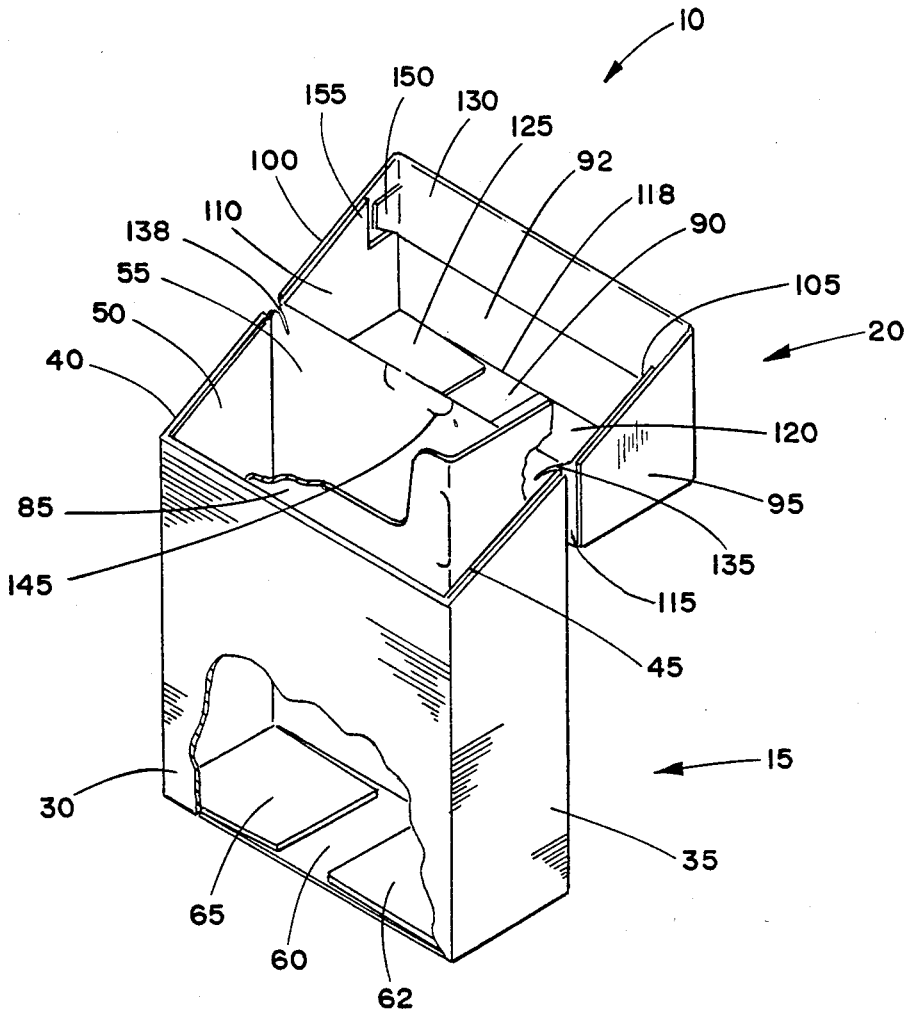

Referring to FIG. 2, hinged lid package 10 is generally similar to the embodiment of FIG. 1, except that lid inner side wall 110 is not shown as cut away. Rather, tab 150 fits into and is held in place within a suitably cut slot 155 within inner side wall 110.

Preferably, the tabs have a shape such that the width of each tab is narrower outward from the lid reinforcing panel than at the fold line between the tab and the lid reinforcing panel.

The package conveniently is secured together by applying adhesive material to the outer surfaces of inner walls 45, 50, 105 and 110. Application of adhesive to the inner surface of the lid reinforcing panel is optional. Adhesives used in the construction of the package will be apparent to the skilled artisan.

Figure 3:
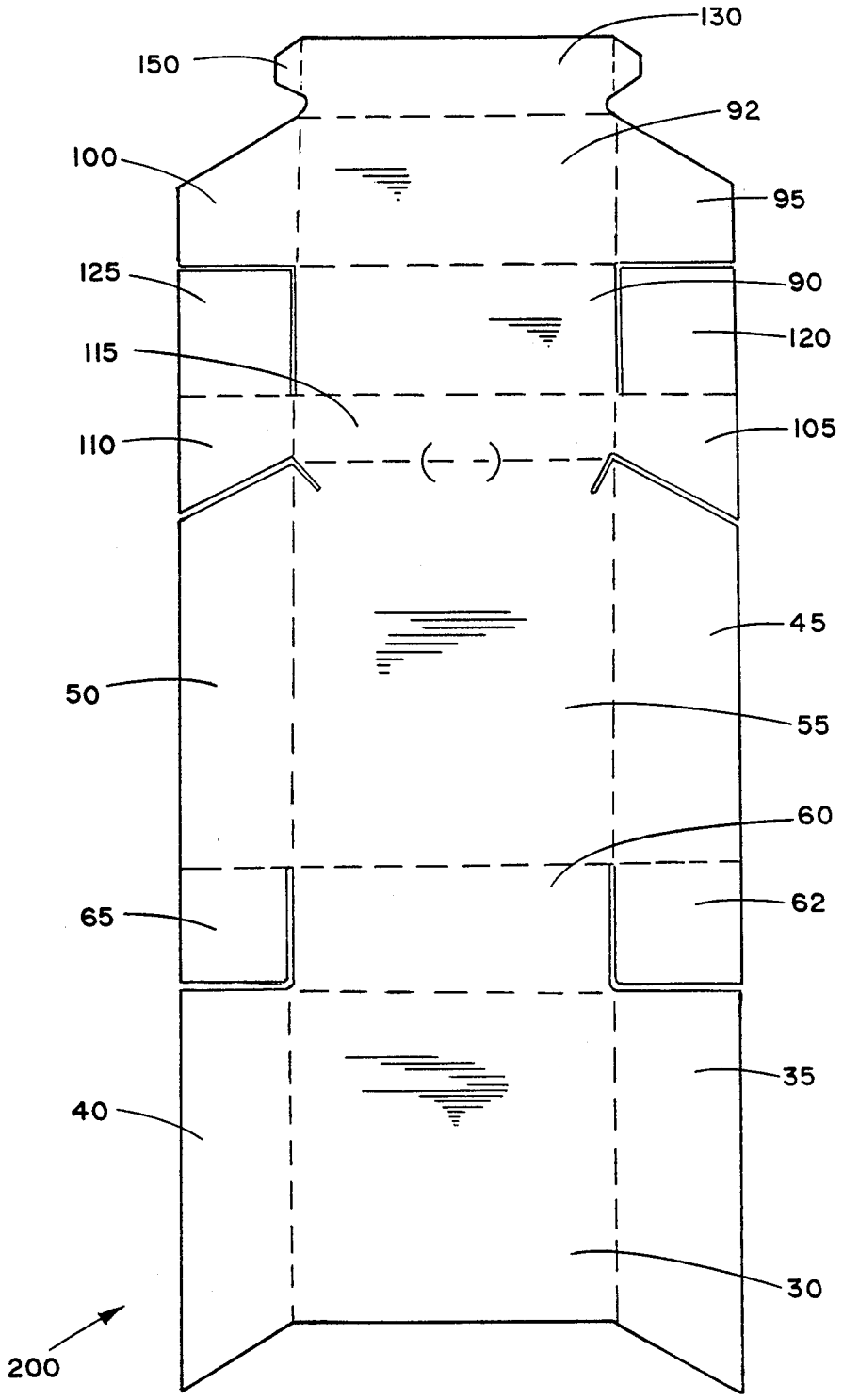
FIGS. 3 and 4 are diagrammatic schematic illustrations of blanks for the manufacture of the body and lid of the package shown in FIGS. 1 and 2, respectively.
Figure 4:
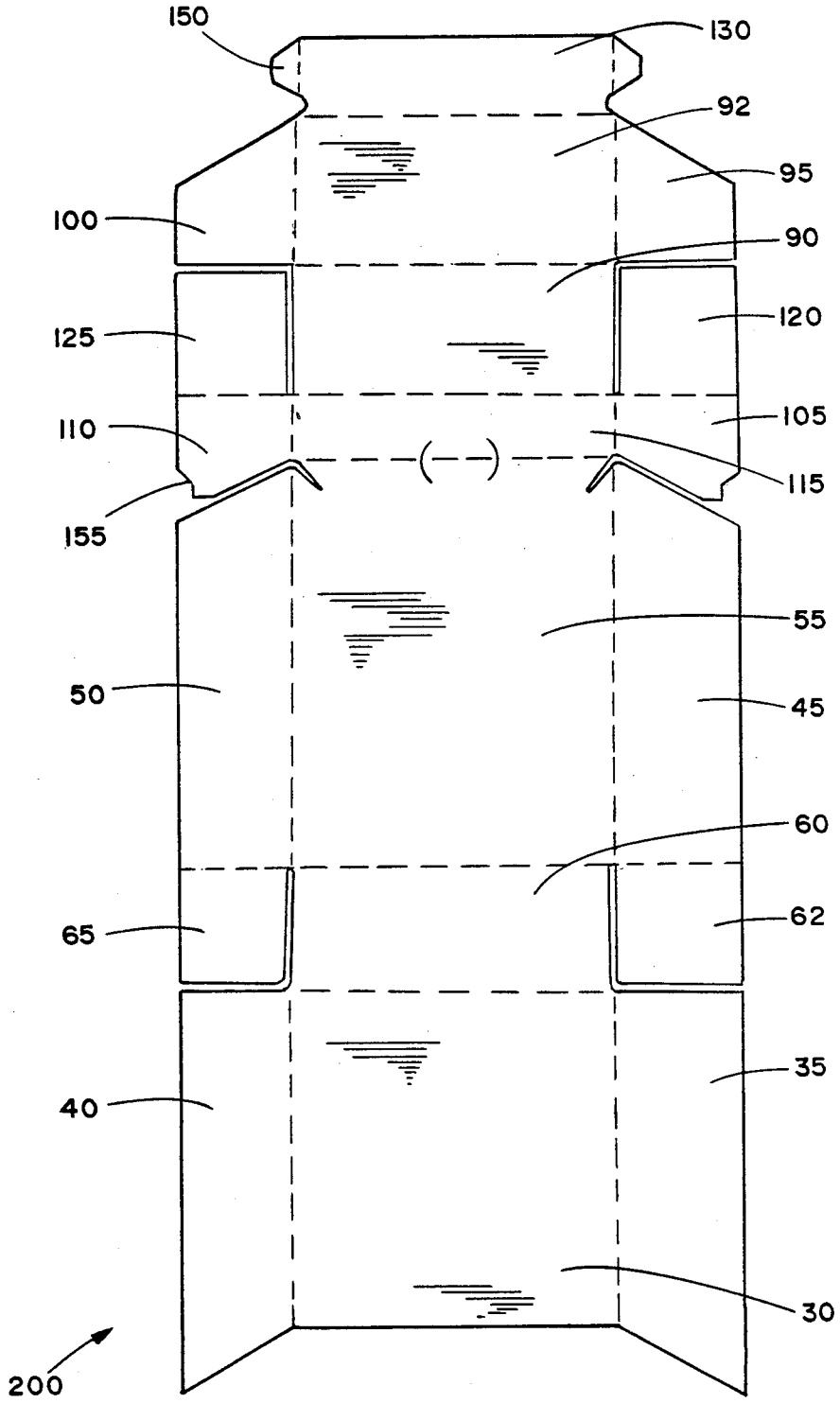

The body and lid of the packages shown in FIGS. 1 and 2 conveniently are provided using known techniques and equipment from blank 200 which is shown in FIG. 3 and 4, respectively. The blank 200 includes a plurality of fold lines, creases or score lines (shown as dotted lines in FIGS. 3 and 4) and a plurality of cuts. The cuts conveniently are made by slitting the blank without removal of material therefrom; however, for illustration purposes, the slit lines are shown in FIG. 2 as slots. The folds and cuts define panels which correspond to the walls and flaps of the package which is constructed from the blank.

The blank can be assembled into a cigarette package containing cigarettes using techniques and equipment known to the skilled artisan.

An example of a representative embodiment of the invention is a hinged lid package having a height of about 85 mm, a width of about 55 mm and a depth of about 20 mm. The package is manufactured from a low density solid bleached sulfate paperboard having a thickness of 0.012 inch and a paperboard inner liner so as to have the configuration shown in either of FIGS. 1 or 2. The body and lid of the package is manufactured from the blank shown in either of FIGS. 3 or 4, respectively. Each tab has a width at the fold line between the tab and the lid reinforcing panel of about 8 mm, a minimum width of about 3 mm, and extends outward to about 4 mm from the fold line between the tab and the lid reinforcing panel.

What is claimed is:

1. An assembled hinged lid cigarette package comprising:

(a) a body portion including a front wall, a bottom wall, a rear wall, inner side walls and outer side walls;

(b) a lid portion including a rear wall integrally hinged to the rear wall of the body portion, a front wall, a top wall, inner side walls, and outer side walls; and (c) lid reinforcing panel integrally connected to the front wall of the lid portion and forming an inner wall of the lid portion, the lid reinforcing panel having tabs integrally connected to each side thereof and held in place between the respective outer and inner side walls of the lid portion.

2. The package of claim 1 wherein the package has a generally rectilinear shape when viewed from the bottom thereof.

3. The package of claim 1 wherein no adhesive is present between the front wall portion and the lid reinforcing panel.

4. The package of claim 1 wherein adhesive is present between the front wall portion and the lid reinforcing panel.

5. The package of claim 1 containing 20 cigarettes.

6. An assembled hinged lid cigarette package comprising:

(a) a body portion including a front wall, a bottom wall, a rear wall, inner side walls and outer side walls;

(b) a lid portion including a rear wall integrally hinged to the rear wall of the body portion, a front wall, a top wall, inner side walls each having respective regions which define a notch, and outer side walls; and (c) lid reinforcing panel integrally connected to the front wall of the lid portion and forming an inner wall of the lid portion, the lid reinforcing panel having tabs integrally connected to each side thereof and held in place within the respective notches of each inner side walls of the lid portion.

7. The package of claim 6 wherein the package has a generally rectilinear shape when viewed from the bottom thereof.

8. The package of claim 6 wherein no adhesive is present between the front wall portion and the lid reinforcing panel.

9. The package of claim 6 wherein adhesive is present between the front wall portion and the lid reinforcing panel.

10. The package of claim 6 containing 20 cigarettes.

* * * * *